US007062181B2

(12) United States Patent
Buchheit

(10) Patent No.: US 7,062,181 B2
(45) Date of Patent: Jun. 13, 2006

(54) SYSTEMS AND METHODS FOR SINGLE WIRE COMMUNICATION AND INTERACTION WITH A CUSTOMER REPLACEABLE UNIT MONITOR

(75) Inventor: Robert F. Buchheit, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/978,423

(22) Filed: Nov. 2, 2004

(65) Prior Publication Data

US 2006/0093383 A1 May 4, 2006

(51) Int. Cl.
*G03G 15/00* (2006.01)

(52) U.S. Cl. ..... 399/24; 399/12; 399/24; 399/25; 399/26; 399/27

(58) Field of Classification Search ..... 399/24, 399/37, 12, 25, 26, 27
See application file for complete search history.

(56) References Cited

U.S. PATENT DOCUMENTS 5,491,540 A * 2/1996 Hirst ..... 399/12
5,835,817 A * 11/1998 Bullock et al. ..... 399/25
6,101,363 A * 8/2000 Tomatsu ..... 399/330
6,181,885 B1 1/2001 Best et al.
6,239,879 B1 5/2001 Hay
6,264,301 B1 7/2001 Helterline et al.
6,351,621 B1 2/2002 Richards et al.
6,556,792 B1 4/2003 Yoshimura
6,597,875 B1 7/2003 Hasegawa
6,623,196 B1 9/2003 Lee et al.
6,694,106 B1 2/2004 Yoshimura
6,710,891 B1 3/2004 Vraa et al.
6,739,691 B1 5/2004 Walker
6,766,121 B1 7/2004 Nonaka et al.
2003/0063311 A1* 4/2003 Covitt et al. ..... 358/1.15

* cited by examiner

*Primary Examiner*—Arthur T. Grimley
*Assistant Examiner*—Joseph S. Wong
(74) *Attorney, Agent, or Firm*—Oliff & Berridge, PLC

(57) ABSTRACT

Single-wire data communications with data storage memory units that may be coupled with a wirelessly energized power supply is enabled in electronic monitoring modules in customer replaceable units (CRUs) such as toner bottles in image forming devices. Communication between modularly designed office equipment and installed CRUs may include data transmission implemented by providing a single point of contact on, for example, a rotational axis at the closed end of a rotating CRU, or by placing a conductive patch, band ring on the periphery of such CRU such that a single-wire data transfer contact is effected with the CRU. A communications link is provided which is not adversely affected by dirt or other foreign objects and is not limited by necessary motion which must be imparted to the CRU for optimum operation in the modular equipment within which the CRU is installed, or other interference that may adversely affects a wireless communications link.

11 Claims, 5 Drawing Sheets

SYSTEMS AND METHODS FOR SINGLE WIRE COMMUNICATION AND INTERACTION WITH A CUSTOMER REPLACEABLE UNIT MONITOR

BACKGROUND OF THE INVENTION

1. Field of Invention

This invention is directed to systems and methods for communicating with power sources, control circuit and data storage memory in replaceable monitoring modules installed in or on customer replaceable units, such as, for example toner bottles and image forming devices.

2. Description of Related Art

U.S. Pat. No. 6,351,621 to Richards et al., which is commonly assigned and the disclosure of which is incorporated herein in its entirety by reference, teaches advantages of organizing, for ease of maintenance, office equipment, particularly image forming devices, on a modular basis. Specifically, Richards et al. explain that a modular design facilitates greater flexibility by providing on-site repair and service of the modularly designed office equipment. This on-site repair and service generally amounts to little more than removing and replacing a defective module. Actual repair of the module then takes place at an off-site service provider's location. Additionally, an organization using modularly designed office equipment may see potential economic benefit from buying supplies of modules in bulk and/or from a competitively lower cost provider. Richards et al. explain also that the use of modules, particularly for supply units such as toner bottles, is conducive to recycling activities.

Conventionally, modules such as those disclosed in Richards et al. are referred to as Customer Replaceable Units or CRUs. Very often, in practical use, CRUs may include an electronically-readable chip which may contain static information regarding, for example, identification of the CRU such as a serial number, a model number or other component identifying feature, and/or dynamic information relating to a particular CRU's operating status such as, for example, fill level, numbers of uses expended, or other indication of projected service life remaining. When an individual CRU is installed in the modularly designed office equipment, a communications interface is established with the electronically-readable chip as a monitor module which may enable the modularly designed office equipment within which the CRU is installed to read data from, and write data to, the monitor module of the CRU.

Richards et al. teach the concept of a "Customer Replaceable Unit Monitor," commonly referred to as a CRUM. A CRUM is generally an electronic device which is permanently associated with a customer replaceable unit such as, for example, those which may be installed in electronic modularly designed office equipment such as printers or copiers. Typically, a CRUM includes a non-volatile memory, such as, for example, in the form of an EEPROM, which retains data relevant to the function and performance of the CRU.

Typical data stored on the CRUM includes identification and/or compatibility information regarding the CRU. Various usage data and/or service life data can also be recorded on the CRUM.

Richards et al. disclose a number of systems and methods which are conventionally employed to provide communications interfaces with the CRUM. Among the systems and methods discussed in that patent are those which provide: a capability to measure and record on a non-volatile memory in a CRU maintenance information such as the total number of pages printed and information regarding the latest failure; an ability to enable a printer to check an identification number of a module such as, for example, to ensure that the module is authorized to be installed in the printer; for multi-color printing capabilities, operational characteristics such as, for example, a code indicating the color of the ink available in the CRU as well as the ability to monitor the amount of ink used and to provide the user warning of impending exhaustion of ink; and many other related capabilities such as, for example, limiting a specific unit to an overall total number of print evolutions or print cycles, or to provide security, or to provide product matching, or to provide tamper resistance, or to provide any other like capability.

Richards et al. teach, as an improvement over a requirement for a hard-wired cable connection for communicating with the CRUM, a system and method for wireless communication with the CRUM. A wireless CRUM system employs magnetic and/or electromagnetic fields to both power and transfer data to and from the CRUM. A method of providing wireless power sourcing and associated control circuitry, and wireless data transfer capability, substantially overcomes any drawbacks associated with earlier hard-wired or multiple contact-type connections that provided a hard-wired source of power and data transfer capability between the office equipment or device in which the CRU is installed, and the monitoring chip or CRUM installed in or on the CRU. Hard-wired connections generally have a disadvantage of limiting any range of motion, or speed of motion, or both, of CRUs which may move by, for example, reciprocating and/or rotating, sometimes at high speed in operation. Many of the disadvantages and/or limitations introduced by the necessity of a hard-wired connection to a moving object are eliminated or reduced through use of wireless communication for power sourcing and/or data transfer, such as that disclosed in Richards et al., to power and control, and/or read from and write to, a CRUM.

SUMMARY OF THE INVENTION

There are, however, situations where radio frequency (RF) or other wireless communications may not be optimum in providing at least one of the power/control and data exchange capability between equipment with a CRU installed and a CRUM in or on such an installed CRU.

For example, in a printer device, as an example of modularly designed office equipment within which a CRU may be installed, there may be a toner bottle as an exemplary embodiment of a CRU. CRU components are made "smart" with the addition of a CRUM and an ability to automatically communicate with the CRUM. Power is required to be delivered to the CRUM and a data exchange communications path such as, for example, a data link and/or a communications link must be established with the CRUM. The toner bottle, as the exemplary embodiment of a CRU, is generally made to rotate, making a hard-wired connection between the equipment and the CRUM impractical. In a simple embodiment, via either a single point on the rotating axis of the CRU, i.e., toner bottle, or via a separate circumferential band or other like communications connection capability, a single wire point of contact may be established. Through this single wire at least one of a power sourcing/control circuitry communications link and a data/information transfer communications link with the CRUM may be established.

In various exemplary embodiments the systems and methods according to this invention may provide separate power/control and data transfer methodologies for communication between the modularly designed equipment and an installed CRU. The separate communications methodologies, may include a wireless power circuit/power supply such as, for example, an air core transformer with a single winding in the control unit and a single winding in a remote unit whereby the control unit can easily power the remote unit, or a light source and a photovoltaic cell. Data transmission may be separately implemented by providing a single point of contact on, for example, a rotational axis at the closed end of a rotating CRU such as, for example, a toner bottle, or by placing a conductive patch, band or ring on the periphery of such toner bottle such that single-wire contact can be made with the CRU for data communication with the separately powered CRUM.

In various exemplary embodiments, the systems and methods according to this invention provide substantially the functionality of wireless communication with a CRUM using a single-wire data transfer capability to replace the wireless communications capability for at least one desired communications link between a CRU and a device.

Exemplary embodiments of this invention may further provide a relatively simple non-interferable data communications capability between the modularly designed equipment within which a typical CRU is employed and a CRUM or other monitor module installed in or on the CRU.

In various exemplary embodiments, the systems and methods according to this invention may also provide a data communications transfer link which is not adversely impacted by dirt or certain other foreign objects in the communications path. Further, exemplary embodiments of this invention are not limited by necessary motion of the CRU in the modular equipment within which the CRU is installed.

These and other features and advantages of the various disclosed embodiments are described in, or apparent from, the following detailed description of the various exemplary embodiments of the systems and methods according to this invention.

BRIEF DESCRIPTION OF THE DRAWINGS

Various exemplary embodiments of the systems and methods according to this invention will be described in detail with reference to the accompanying figures, with like features having like reference numbers, wherein.

DETAILED DESCRIPTION OF PREFERRED EMBODIMENTS

The following description of various exemplary embodiments of the systems and methods for single-wire communication with a customer replaceable unit monitor module or CRUM may refer to a toner bottle in an image forming device as an exemplary embodiment of a customer replaceable unit or CRU within or upon which a CRUM is installed, for the sake of clarity, familiarity and ease of depiction and description. However, it should be appreciated that the principles of this invention as outlined and/or discussed below can be equally applied to any modular customer replaceable unit in virtually any application, not limited to image forming devices and/or other office equipment, in which an electronically-readable chip is installed in a customer replaceable component to provide static or dynamic information regarding characteristics, configuration and/or other details of the customer replaceable component to the device in which the customer replaceable component is installed.

Various exemplary embodiments of the systems and methods according to this invention provide interface between modularly designed equipment and modular CRUs installed therein, and more specifically provide a link for power sourcing and associated control circuitry, and a data transfer communications link between the equipment and the CRUM, at least one of which links is provided across a single wire installed in the equipment to communicate via a compatible contact interface with the CRUM on the CRU.

Figure 1:
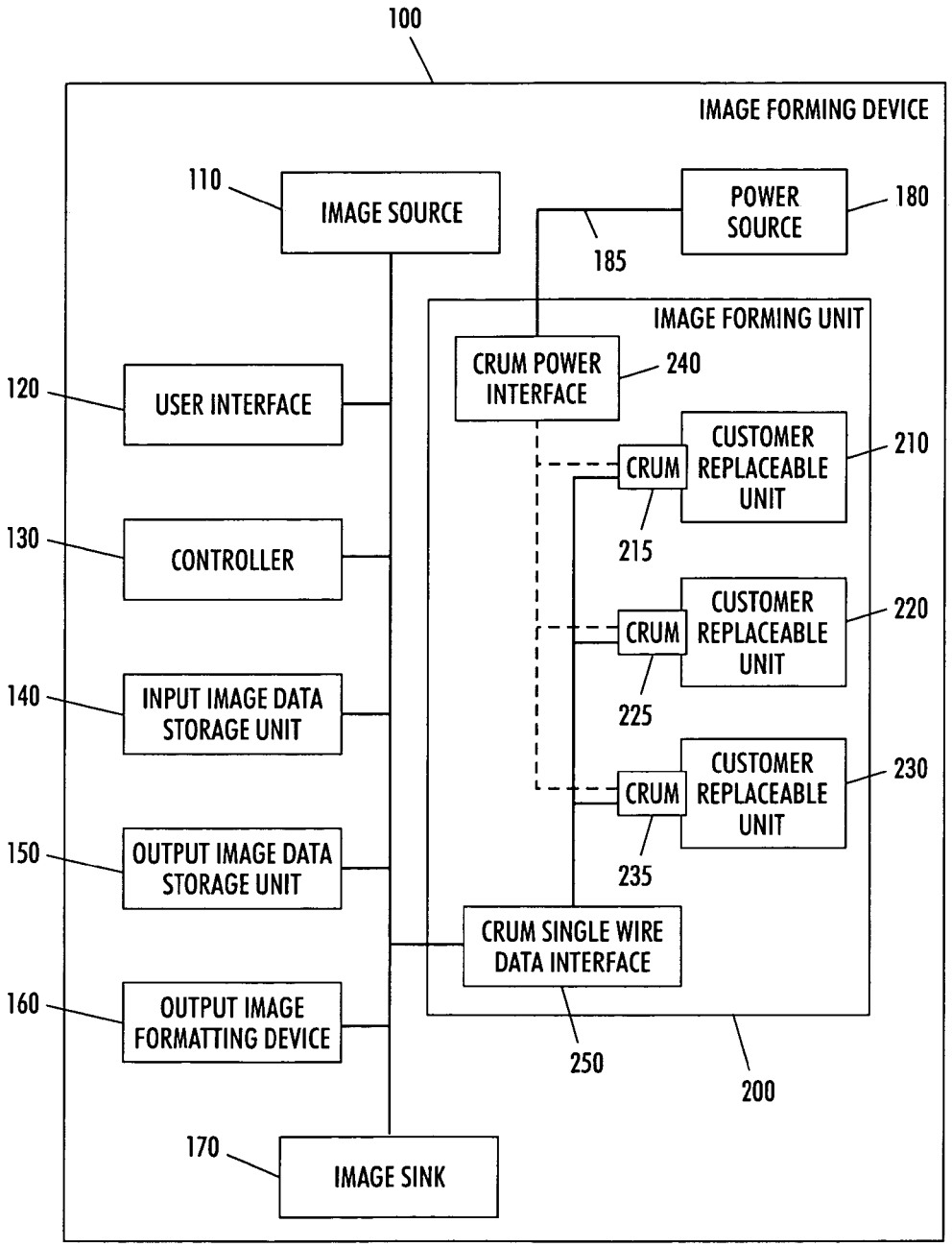
FIG. 1 illustrates a functional block diagram of an image forming device as an exemplary embodiment of modularly designed equipment usable with the systems and methods according to this invention.

FIG. 1 illustrates a functional block diagram of an image forming device 100 as an exemplary embodiment of modularly designed equipment usable with the systems and methods according to this invention. As shown in FIG. 1, the exemplary image forming device 100 includes an image data source (hereafter referred to simply as an image source) 110, a user interface 120, a controller 130, an input image data storage unit 140, an output image data storage unit 150, an output image formatting device 160, an image data sink (hereafter referred to simply as an image sink) 170 and an exemplary image forming unit 200, all connected by a data/control bus 175. A separate power source 180 is provided in order to power individual units within the image forming device 100 as necessary. Specifically, the power source 180 is available to provide power to a CRUM power interface 240 in the image forming unit 200 via a power bus 185 between the power source 180 and the CRUM power interface 240. This CRUM power interface 240 will be described in further detail below.

It should be recognized that though depicted as individual elements internal to the exemplary image forming device 100, various ones of the depicted units and elements may alternatively be connected externally to the exemplary image forming device 100. In such a case where one or more of the depicted components is externally connected to the main body of the image forming device 100, the data/control bus 175 is extended either in a wired connection, or through a wireless data communications capability, to the one or more external devices, or is connected to an input/output interface through which wired or wireless communication with the one or more external components may be effected.

In various exemplary embodiments of the systems and methods according to this invention, an exemplary image forming unit 200 includes at least one customer replaceable unit or CRU. Such generic CRUs are depicted in FIG. 1 as 210, 220, 230, each connected to the data/control bus 175 of the exemplary image forming device 100 via a customer replaceable unit monitor module (CRUM) 215, 225, 235 which in turn communicates with the data/control bus 175 via a CRUM single wire data interface 250. The CRUMs require power which in the exemplary embodiment depicted in FIG. 1 is provided from a power source 180 in the image forming device 100 through a power bus 185 to a CRUM power interface 240 which then may provide wireless communication of a power signal to each of the CRUMs 215, 225, 235. This wireless communication is depicted by the dashed line in FIG. 1. Such wireless power sourcing for the CRUMs 215, 225, 235 will be described in an exemplary manner below.

It should be appreciated that, while the depiction in FIG. 1 shows the CRUMs 215, 225, 235 apparently mounted externally to the CRUs 210, 220, 230, this depiction is simply for ease of illustration of the various components and should not be regarded as limiting. It should be further appreciated that in exemplary systems and methods according to this invention, the CRUMs 215, 225, 235 may be mounted on the inside of the CRUs 210, 220, 230 and the information could be read therefrom via the connections to the power interface 240 and the single wire data interface 250 as will be described in detail below. Also, for eases of depiction and description, the communications link for power/control circuitry in the exemplary embodiments will be described as wireless. The single wire communications capabilities will, in turn, be described in conjunction with data/information exchange with the CRUM. This configuration may be preferable for reasons enumerated below, but it should be appreciated that systems and methods in which the power sourcing link is via a single wire and the data transmission link is wireless are contemplated.

Figure 2:
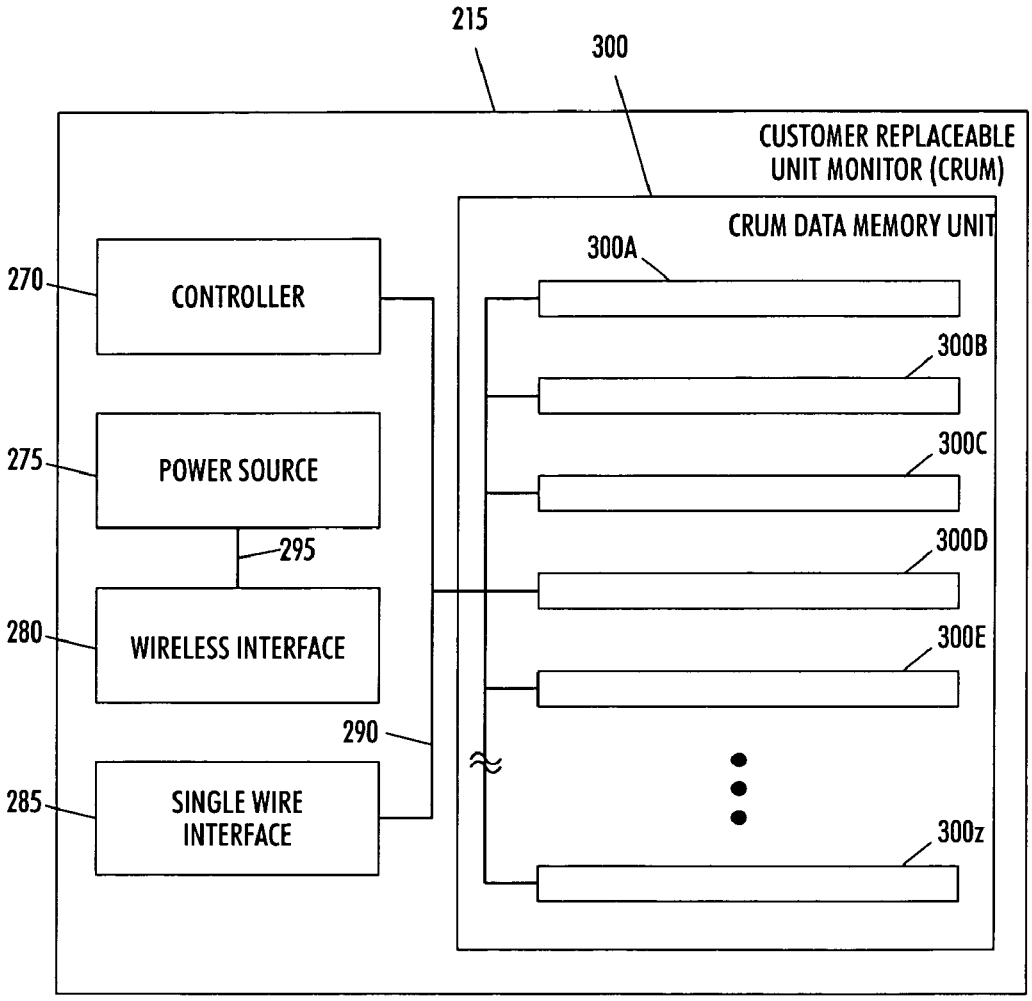
FIG. 2 illustrates a functional block diagram of an exemplary customer replaceable unit monitor or CRUM usable with the systems and methods according to this invention.

FIG. 2 illustrates a functional block diagram of an exemplary customer replaceable unit monitor or CRUM 215 usable with the systems and methods according to this invention. As shown in FIG. 2, the exemplary CRUM 215 includes a controller 270, a wireless interface 280, a single wire interface 285, and a CRUM data memory unit 300, all connected to a data/control bus 290 within the exemplary CRUM 215. For power sourcing to the CRUM, a power source unit 275 is depicted. Such power source unit 275 may represent, for example, one-half of an air core transformer, or alternatively a photovoltaic cell, or other like power source which communicates via wireless means to a compatible CRUM power interface 240, depicted in FIG. 1. Such a wireless communications interface may provide power sourcing directly, or via an alternative wireless interface 280 which is provided for other wireless communications with the CRUM across a separate CRUM power bus 295 between the wireless interface 280 and the power source 275. Although depicted as individually discrete elements, it should be appreciated that the elements which comprise the CRUM may be formed in any combination on, for example, an electronic chip.

In various exemplary embodiments of the systems and methods according to this invention, the single wire interface 285 connected to the CRUM data memory unit 300 by the data/control bus 290 provides a data and communications link for data/information transfer between the exemplary modularly designed equipment, such as, for example, the exemplary image forming device 100 depicted in FIG. 1, and the individual CRUM 215 mounted in the respective CRU 210 within the modularly designed equipment.

The CRUM memory data unit 300 may be a non-volatile memory unit in which is stored any data which a CRU distributor may want a user to have, generally regarding configurations and/or characteristics of the CRU. Such data may include, but is not limited to, model and serial numbers for the CRU; compatibility information with the modularly designed equipment within which the CRU is intended to be installed; operating information, such as, for example, levels of any expendable component found within the CRU, life unit indices, or other measurements of either expended life or expected operating life remaining. Such individual units of information may be stored discretely in individual data memory storage locations 300A–300Z as depicted in FIG. 2. A typical example of use for such data is when, for example, a CRU distributor wants to limit a toner bottle to 10,000 copies and no more. Such service life restriction is available and could optionally be guaranteed by overfilling a toner bottle and having the CRUM 215 in or on that toner bottle record the number of printing operations in which that toner bottle is involved. Once the count reaches 10,000, the toner bottle is rendered no longer operable.

In various exemplary embodiments of the systems and methods according to this invention, energy transfer between the modularly designed equipment in which the CRU is installed and the CRUM in or on the CRU includes two parts. Energy must be transferred from a power control unit represented by the CRUM power interface 240 shown in FIG. 1 to a power source 275 within the CRUM 215. This energy transfer, which could occur through a wired interface, will be depicted and discussed in the exemplary embodiments according to this invention as limited to wireless energy transfer either directly or via a wireless interface 280 in the CRUM 215. Such wireless energy transfer may occur between a control unit such as the CRUM power interface 240 in the image forming device 100 and a remote unit such as the power source 275 in the CRUM 215 by use of, for example, an air core transformer with one winding in the control unit and one in the remote unit, or a photovoltaic power source with a light source in the control unit and a photovoltaic cell in the remote unit, or other like power sourcing. In other words, the windings of air core transformer, or alternatively the light source and photovoltaic cell, would correspond respectively to the CRUM power interface 240 and the wireless interface 280. When one of the power/control circuitry and the data transfer circuitry is to be wired via a single wire and the other is to be wireless, it is preferable to use the single wire interface for transfer of data because of the comparatively lower level energy transfer related to data as compared to the much higher level power/control energy. Beyond the discussion of exemplary power/control energy transfer above, the systems and methods concerning an air core transformer providing an external power source via a wireless interface 280 in communication with an internal power source 275 such as may be employed in an exemplary CRUM 215 is well known to those of ordinary skill in the art and as such, does not require further explanation.

Figure 3:
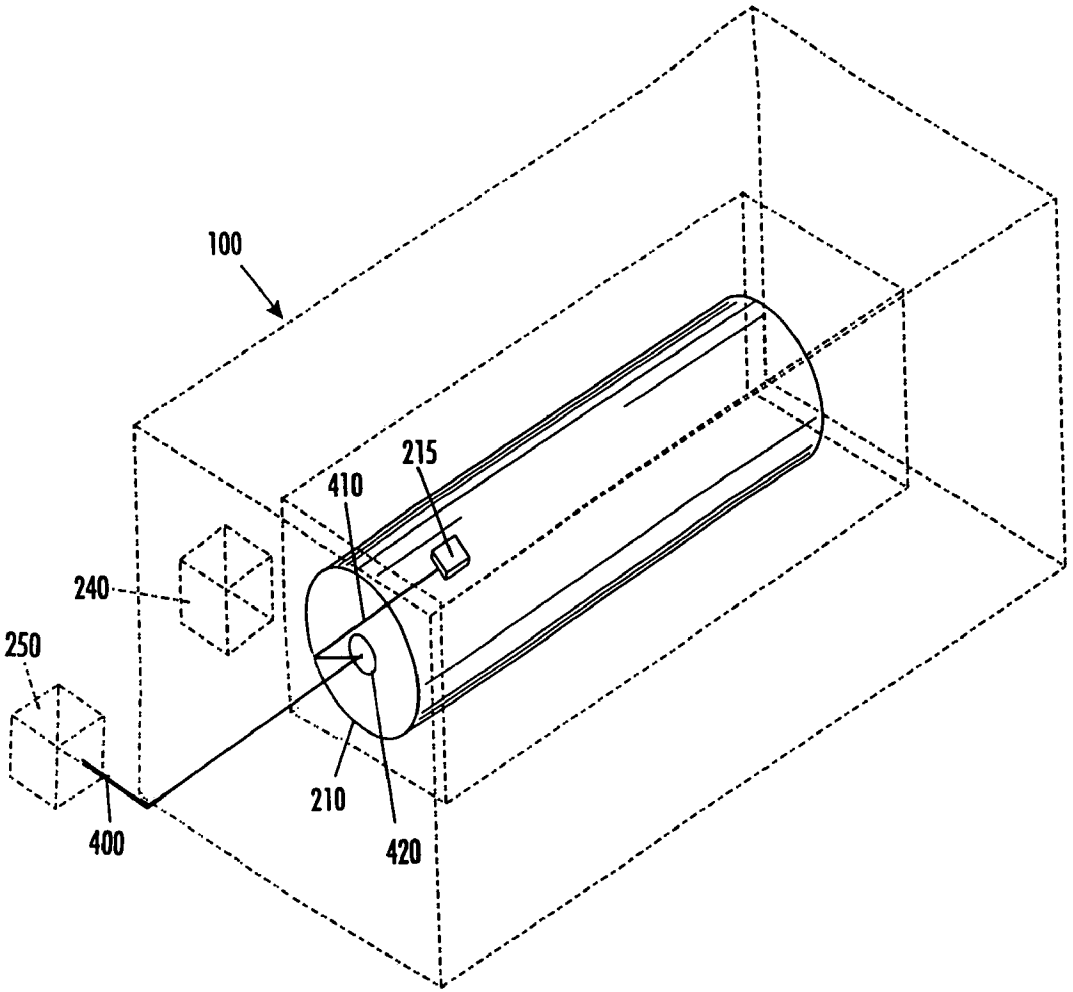
FIG. 3 illustrates an exemplary embodiment of a customer replaceable unit or CRU located in an exemplary image forming device, with a first exemplary embodiment of a single-wire communications link according to the systems and methods of this invention.

FIG. 3 illustrates an exemplary embodiment of a customer replaceable unit CRU 210 located in an exemplary image forming device 100 with a first exemplary embodiment of a single-wire communications link according to the systems and methods of this invention. As shown in FIG. 3, an exemplary CRU 210 is provided with a CRUM 215 mounted inside the CRU 210. The CRUM 215 is powered by a wireless connection between a wireless CRUM power interface 240 and the CRUM 215.

In this exemplary embodiment, data transfer between the CRUM 215 and the image forming device 100 within which the CRU 210 is housed is accomplished through a single wire connection 400 with an exemplary CRUM single wire interface 250. In order to complete the connection between the CRUM 215 and the CRUM single wire interface 250, the CRUM 215 may be provided a wired connection 410 internal to the CRU 210 and a single point single wire interface connection 420 by which the single wire connection 400 can interface with the exemplary CRU 210 even if the CRU 210 rotates within the image forming device 100. In this exemplary embodiment, the single point single wire interface connection 420 is located, in an exemplary manner, on the rotational axis of the CRU 210. A single wire data transfer connection is thus established between the CRUM 215 internal to the CRU 210 and the CRUM single wire interface 250 in the exemplary image forming device 100 when the CRU 210 is installed in the image forming device 100.

It should be appreciated that the exemplary CRUM 215 depicted as internal to the CRU 210 may be mounted on or embedded in any internal or external surface of the CRU 210. Such mounting could advantageously include the CRUM 215 being mounted internal or external to the end rotating face of the CRU 210 such that the wired connection may be minimized or eliminated. Where required, the wired connection 410 internal to the CRU 210 may substantially be embedded in or mounted on an internal or external surface of the exemplary CRU 210 so long as connection between the exemplary CRUM 215 and the single point single wire interface connection 420 is maintained. As such, the wired connection 410, when present, may generally be a relatively stiff wire that resiliently contacts the single point single wire interface connection 420. It should be further appreciated that, in like manner, were the CRUM 215 mounted internal or external to the end rotating face of the CRU 210, the CRUM power interface 240 may be advantageously relocated to a position substantially in line with the rotating axis of the CRU 210 thereby generally facilitating a potentially continuous powering of the CRUM 215 that may not otherwise occur in the configuration depicted in FIGS. 3–5.

Figure 4:
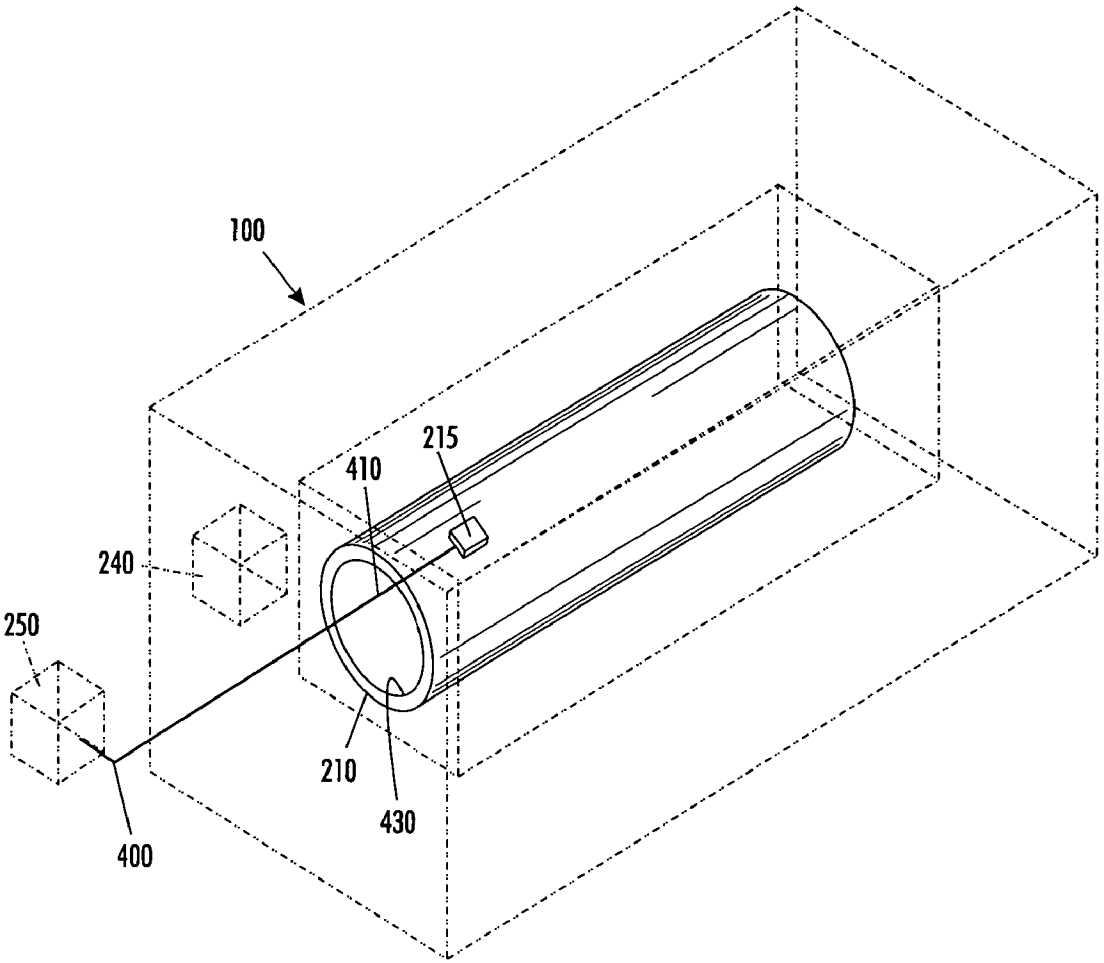
FIG. 4 illustrates an exemplary embodiment of a customer replaceable unit or CRU located in an exemplary image forming device, with a second exemplary embodiment of a single-wire communications link according to the systems and methods of this invention.

FIG. 4 illustrates an exemplary embodiment of a customer replaceable unit or CRU 210 located in an exemplary image forming device 100 with a second exemplary embodiment of a single wire communications link according to the systems and methods of this invention. As shown in FIG. 4, substantially all of the numbered components which were described with respect to FIG. 3 remain the same.

In this exemplary embodiment, data transfer between the CRUM 215 and the modular image forming device 100 within which the CRU 210 is housed is accomplished by replacing the single point single wire interface connection 420 of the first embodiment depicted in FIG. 3 with a circular ring single wire interface connection 430 concentric with the rotational axis, and in the rotating end, of the CRU 210. The single wire 400 in this case makes contact with this circular ring single wire interface connection 430 as the exemplary CRU 210 rotates. A single wire data transfer connection is thus established between the CRUM 215 internal to the CRU 210 and the CRUM single wire interface 250 of the image forming device 100.

Figure 5:
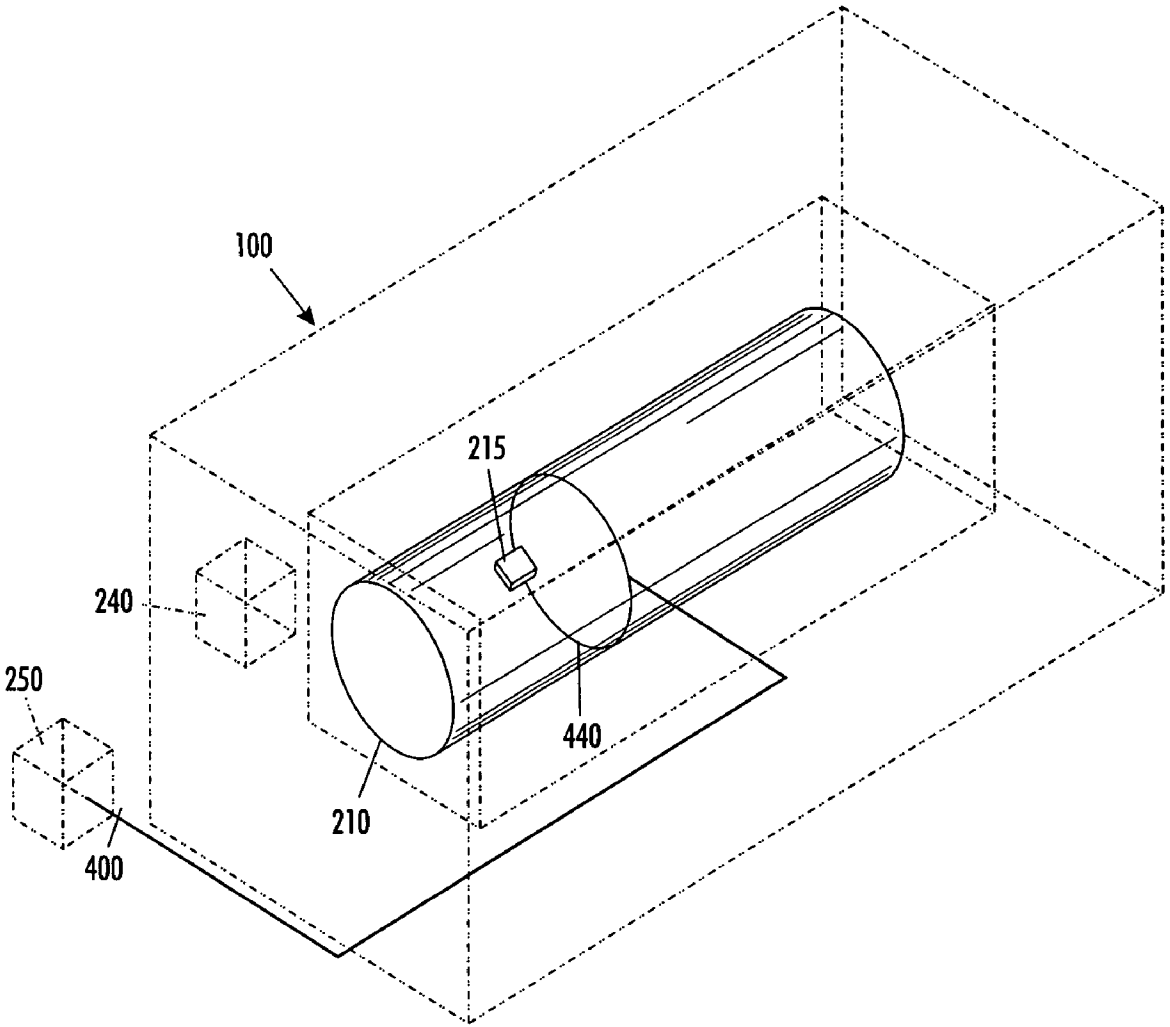
FIG. 5 illustrates an exemplary embodiment of a customer replaceable unit or CRU located in an exemplary image forming device, with a third exemplary embodiment of a single-wire communications link according to the systems and methods of this invention.

FIG. 5 illustrates an exemplary embodiment of a customer replaceable unit or CRU 210 located in an exemplary image forming device 100 with a third exemplary embodiment of a single wire communications link according to the systems and methods of this invention. As shown in FIG. 5, substantially all of the numbered components of the previous two embodiments remain substantially the same.

In this exemplary embodiment, the wired connection 410 internal to the CRU 210 has been replaced by a wired connection through the wall of the CRU 210 adjacent to the CRUM 215 to establish a wired connection to a circumferential ring single wire interface connection 440 mounted on an external surface of the CRU 210. The CRUM 215 is wired to the ring 440 and the single wire connection 400 makes contact with and tracks along the circumferential ring single wire interface connection 440 when the CRU 210 is in motion. A single wire data transfer connection is thus established between the CRUM 215 internal to the CRU 210 and the CRUM single wire interface 250 of the image forming device 100.

It should be appreciated that, while in the exemplary embodiments depicted in FIGS. 3–5 the CRUM 215 is shown as located internal to the CRU 210, as was noted above, such positioning is illustrative and not meant to be in any way limiting. For example, the CRUM 215 could alternatively be located on, or integral to, an external surface of the CRU 210. In any case, a wired connection is established between the CRUM 215 and a point of contact for the single wire connection 400 in order that a complete communications link can be established between the CRUM 215 and the CRUM single wire interface 250 of the exemplary image forming device 100.

It should be appreciated that any like link which provides access of a single wire as a data patch to the CRUM 215 which does not restrict operational movement of the CRU 210 is acceptable. Additionally, it should be noted that across this communication link such small power is required when transferring data/information that it is less affected by dirt or other minor obstruction than if larger amounts of current were being passed which required more significant electrical contract. Such is based on the fact that the data/information is being pushed or pulled at a higher frequency and as a result a small added series capacitance will not have a deleterious effect on the signal.

It should be appreciated that, while the systems and methods according to this invention have been described in conjunction with a toner bottle as an example of a CRU movably mounted within an exemplary image forming device, the systems and methods according to this invention are not limited to such applications but may be applied to virtually any apparatus wherein an electronic chip is mounted on or in a moving component and data transfer between the equipment within which the "smart" module is mounted and the module itself may be facilitated across a single wire communications connection.

While this invention has been described in conjunction with the exemplary embodiments outlined above, various alternatives, modifications, variations and improvements, whether known or that may be presently unforeseen may be come apparent. Accordingly, the exemplary embodiments of this invention, as set forth above, are intended to illustrative, not limiting. Various changes may be made without departing from the spirit and scope of the invention. Therefore, the systems and methods according to this invention are intended to embrace all known or later developed alternatives, modifications, variations and improvements.

What is claimed is:

1. A modular device monitoring system, comprising:

a replaceable modular component installable in a device, the replaceable modular component rotating in operation in the device;

a monitor unit associated with the replaceable modular component, the monitor unit being at least one of integral to, mounted on and located within the replaceable modular component;

a connection from the monitor unit to a single wire interface on an external surface of the replaceable modular component; and a single wire link between the single wire interface on the external surface of the replaceable modular component and the device within which the replaceable modular component is installed, the single wire link being usable to transfer at least one of data and a power signal data between the monitor unit associated with the replaceable modular component and the device, wherein the single wire interface is at least one of a single point on a rotational axis of the replaceable modular component, a circular ring on a rotating end of the replaceable modular component, or a circumferential band around a rotating body of the replaceable modular component.

2. The system of claim 1, wherein the monitor unit comprises:

a data storage unit for storing at least one of configuration information and characteristic information regarding the replaceable modular component;

an interface usable to facilitate transfer of information from the data storage unit to the connection; and a power source to provide power to the monitor unit.

3. The system of claim 2, wherein the at least one of configuration information and characteristic information is at least one of identification information, tamper resistance information, use information, maintenance information, failure information, remanufacture information and remaining service life information.

4. The system of claim 2, wherein the power source comprises a receiving unit which is capable of transferring to the monitor unit power received via a wireless interface with a transmitting unit in the device external to the replaceable modular component.

5. The system of claim 2, wherein the power source comprises or is part of an air core transformer.

6. The system of claim 1, wherein the device is an image forming device.

7. The system of claim 1, wherein the replaceable modular component is an image producing medium holding component.

8. The system of claim 7, wherein the image producing medium is one of ink and toner.

9. A method for monitoring a replaceable modular component installed in a device, the replaceable modular component having an attached monitor unit with a non-volatile memory data storage unit, the monitor unit being connected to a wired interface contact area on an external surface of the replaceable modular component, the method:

contacting the wired interface with a single wire thus establishing a single wire communications link between the replaceable modular component and the compatible device within which the replaceable modular component is installed, the replaceable modular component rotating in operation in the device and the single wire contacting at least one of a single point on a rotational axis of the replaceable modular component, a circular ring on a rotating end of the replaceable modular component, or a circumferential band around a rotating body of the replaceable modular component; and at least one of reading information from the non-volatile memory data storage unit in the monitor unit to the device, writing information from the device to the non-volatile memory data storage unit in the monitor unit, and powering the monitor unit is effected via the single wire communications link.

10. The method of claim 9, wherein at least one of reading information from the non-volatile memory data storage unit in the monitor unit to the device, writing information from the device to the non-volatile memory data storage unit in the monitor unit, and powering the monitor unit includes at least one of reading information and writing information, and specifically excludes powering the monitor unit, powering the monitor unit occurring via a separate power source at least one of within the monitor unit itself and otherwise in communication with the monitor unit.

11. The method of claim 9, wherein at least one of reading information from the non-volatile memory data storage unit in the monitor unit to the device, writing information from the device to the non-volatile memory data storage unit in the monitor unit, and powering the monitor unit is limited specifically to powering the monitor unit, reading information and writing information occurring separately via other data transfer and communications links between the device and the monitor unit.

* * * * *